US007887380B2

(12) United States Patent
Ross

(10) Patent No.: US 7,887,380 B2
(45) Date of Patent: Feb. 15, 2011

(54) METHOD FOR THE PRODUCTION OF A CABLE LUG, AND CABLE LUG

(75) Inventor: Harald Ross, Radevormwald (DE)

(73) Assignee: Gustav Klauke GmbH (DE)

( * ) Notice: Subject to any disclaimer, the term of this patent is extended or adjusted under 35 U.S.C. 154(b) by 28 days.

(21) Appl. No.: 12/522,722

(22) PCT Filed: Jan. 14, 2008

(86) PCT No.: PCT/EP2008/050315

§ 371 (c)(1),
(2), (4) Date: Aug. 5, 2009

(87) PCT Pub. No.: WO2008/087105

PCT Pub. Date: Jul. 24, 2008

(65) Prior Publication Data

US 2010/0014942 A1 Jan. 21, 2010

(30) Foreign Application Priority Data

Jan. 17, 2007 (DE) ..... 10 2007 003 349
Feb. 6, 2007 (DE) ..... 10 2007 005 810

(51) Int. Cl.
*H01R 11/11* (2006.01)

(52) U.S. Cl. ..... 439/883; 439/887; 29/882; 29/885

(58) Field of Classification Search ..... 439/883, 439/887; 29/882, 885
See application file for complete search history.

(56) References Cited

U.S. PATENT DOCUMENTS 1,067,702 A * 7/1913 Wiegand ..... 439/868
1,156,710 A * 10/1915 Rowe ..... 29/874
1,175,311 A * 3/1916 Sherman ..... 439/883
RE14,401 E * 12/1917 Andrews ..... 29/874
1,277,765 A * 9/1918 Smith ..... 439/883
1,650,295 A * 11/1927 Patten ..... 439/868
1,959,150 A * 5/1934 Basch et al. ..... 219/85.15
2,109,073 A * 2/1938 Nieman ..... 439/868
2,371,469 A * 3/1945 Rogoff ..... 439/877
2,957,226 A * 10/1960 Dibner ..... 29/874
2,968,788 A * 1/1961 Neaderland et al. ..... 439/883

(Continued)

FOREIGN PATENT DOCUMENTS

DE 77 35 059 4/1979

(Continued)

OTHER PUBLICATIONS

International Search Report dated Jul. 14, 2008; Seven (7) pages.

(Continued)

*Primary Examiner*—Ross N Gushi
(74) *Attorney, Agent, or Firm*—Clark Hill PLC

(57) ABSTRACT

A cable or a cable receptacle and a method of forming same are disclosed. The cable lug or cable receptacle has a flat part and a tube portion integrally formed together as one piece. The flat part has opposing surfaces which abut against each other. The flat part and the tube portion are plated with tin such that an integral bond is established between the abutting surfaces of the flat part.

15 Claims, 2 Drawing Sheets

U.S. PATENT DOCUMENTS

| | | | | | |
|---|---|---|---|---|---|
| 3,573,721 | A | * | 4/1971 | Teagno et al. | 439/877 |
| 3,693,138 | A | * | 9/1972 | Pertuit | 439/723 |
| RE28,877 | E | * | 6/1976 | Pertuit | 439/723 |
| 4,049,335 | A | * | 9/1977 | Julian et al. | 439/892 |
| 4,483,910 | A | * | 11/1984 | Julian | 429/179 |
| 4,679,888 | A | * | 7/1987 | Williams | 439/883 |
| 4,693,688 | A | * | 9/1987 | Cembruch et al. | 439/877 |
| 5,620,338 | A | * | 4/1997 | Stephens et al. | 439/522 |
| 7,174,633 | B2 | * | 2/2007 | Onuma | 29/854 |
| 2007/0184715 | A1 | | 8/2007 | Onuma | |
| 2009/0162135 | A1 | | 6/2009 | Frenken | |

FOREIGN PATENT DOCUMENTS

| | | |
|---|---|---|
| DE | 199 07 276 | 9/2000 |
| DE | 103 26 004 | 12/2004 |
| EP | 951 098 | 10/1999 |

OTHER PUBLICATIONS

PCT Written Opinion dated Jul. 24, 2008; Sixteen (16) pages.

* cited by examiner

METHOD FOR THE PRODUCTION OF A CABLE LUG, AND CABLE LUG

This patent application is a the National Stage filing of IB application number PCT/EP2008/050315, filed Jan. 14, 2008, published as WO 2008/087105 on Jul. 24, 2008. IB application number PCT/EP2008/050315 claims priority from German Patent Application Nos. 10 2007 003 349.6 dated Jan. 17, 2007 and 10 2007 005 810.3 dated Feb. 6, 2007. Each of these applications are hereby incorporated by reference herein in their entireties.

BACKGROUND OF THE INVENTION

The invention relates to a method for producing a cable lug, or a cable receptacle, from a metallic tube portion. The subject matter also extends to a cable lug having a flat part and a plug-in tube portion.

Production of cable lugs of this kind, and such cable lugs themselves, are known in a multiplicity of configurations. Reference is made to DE 102005007203 A1 as prior art.

It is also known to coat cable lugs of this kind with tin, specifically to coat them with tin by hot dipping. In this however, deficiencies occur, in particular in respect of a required tightness of the tube portion, further costly production steps being necessary to obviate these deficiencies.

SUMMARY OF THE INVENTION

A method is provided for producing a cable lug or a cable receptacle that has the desired impermeability and enables the advantages of a cable lug coated with tin to be achieved, but is convenient to produce. In addition, a cable or a cable receptacle coated with tin in an advantageous manner is to be provided.

This is met, initially in respect of production, by providing the tube portion with an initial coat of tin by electroplating. A copper or steel tube portion is provided. This tube portion is pressed together at one end to form the typical flat part for a cable lug. The tube portion is heated after the pressing-together so that a firmly-bonded connection is established in the region of the surfaces that lie on one another in the flat part because of the tin coating. This forms a braze-like connection. This connection ensures the desired impermeability in the flat part end region of the tube portion, without further action being required.

Similarly, there is produced in this way a cable receptacle which does not necessarily have a through opening in the region of the flat part. In particular, the cable receptacle may have a tube portion with opposed openings at both ends, into which a cable may be inserted. The desired tightness is achieved by the flat part formations—these being central in the present case. Cable receptacles of this kind are also called butt connectors. An opening may however also be provided in the—central—flat part portion for mounting for example by means of a screw (threaded screw).

Preferably, the heating is carried out up to more than 200° C., more preferably up to more than 250° C. It is as a rule desired for the heating to be carried out to above the melting temperature of the tin coating. The heating may be carried out in different ways, thus for example either by induction or by radiation.

It is also pertinent that a braze-like connection may be effected, without a flux having to be used.

Because of the tin-plating, there is no significant mechanical load in regard to production, once this tin-plating has been carried out before pressing, thus on the blank tube portion. A desired coating thickness may also be set in advantageous manner. A layer thickness in the range 2-10 μm is preferred, the integer intermediate values and the range of tenths also being disclosed; thus, purely by way of example, also a layer thickness of 2.5 μm or 8.6 μm etc. The tin coating thus produced undergoes the pressing into a flat part substantially without any great difficulty. Any possible damage can also likewise be "remedied" in the subsequent heating carried out after the pressing. At the same time, the heating mentioned acts, as needs be even favourably, on the microstructure of the material used for the cable lug or the cable receptacle.

It is particularly preferred for the tube portion or the pressed tube portion to be heated under an inert gas. In this way, damage to the material may be avoided still more advantageously.

Preferably before the heating, this being however also in principle possible after the heating, punching/stamping is carried out in the region of the flat part in order to form a conventional cable lug, specifically to achieve a desired rounding at the front edge in conventional manner and to provide a conventional through opening in the flat region.

In regard to the blank portions of the cable lug resulting from this, it may be useful to undertake a further, preferably second, tin-plating after this. In many cases, this is however not required, depending on the demands which are placed on the cable lug.

In regard to subject matter, the cable lug and the cable receptacle are characterized by an integral bond being produced in the region of the superimposed surfaces of the flat part, specifically a fused tin connection, and this is continuous in the flat part. In regard to impermeability, seen from the plug-in tube portion, there results therefore an extended bonding layer which is at the same time thin in the manner of a film and has to have a multiplicity or chain of failure points, if lack of tightness is to come about. This is for all practical purposes impossible.

BRIEF DESCRIPTION OF THE DRAWINGS

The invention is described further below with reference to the accompanying drawing, which however only shows an exemplary embodiment. In the drawings.

Figure 1:
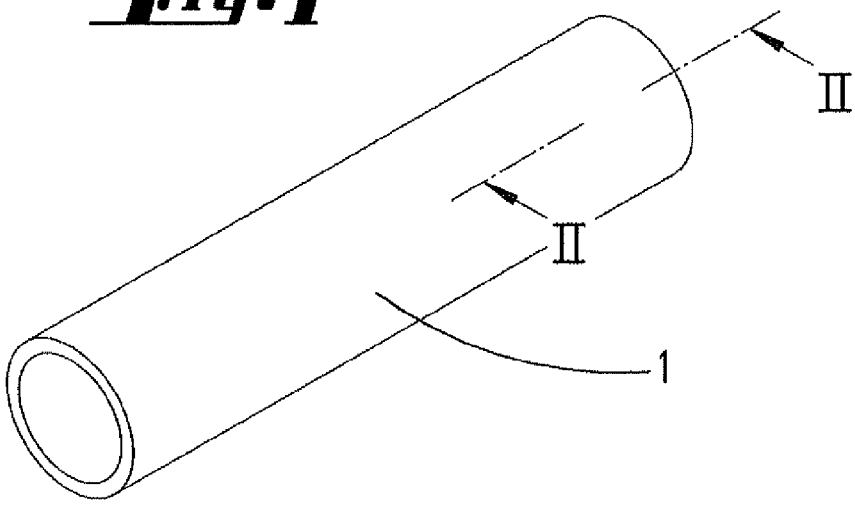
FIG. 1 shows a metallic tube portion coated with tin.
Figure 2:
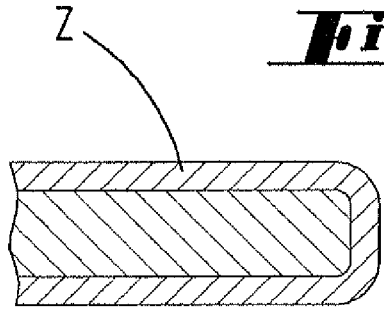
FIG. 2 shows a detail enlargement, on the line II-II in FIG. 1 through one side of the tube portion.

Shown and described in first instance is a tube portion 1, FIG. 1, which is a copper tube portion coated with tin. The tin coating has been applied by electroplating. Accordingly, the tube portion is coated on its entire inner and outer surface with a continuous layer Z of tin, see FIG. 2.

Figure 3:
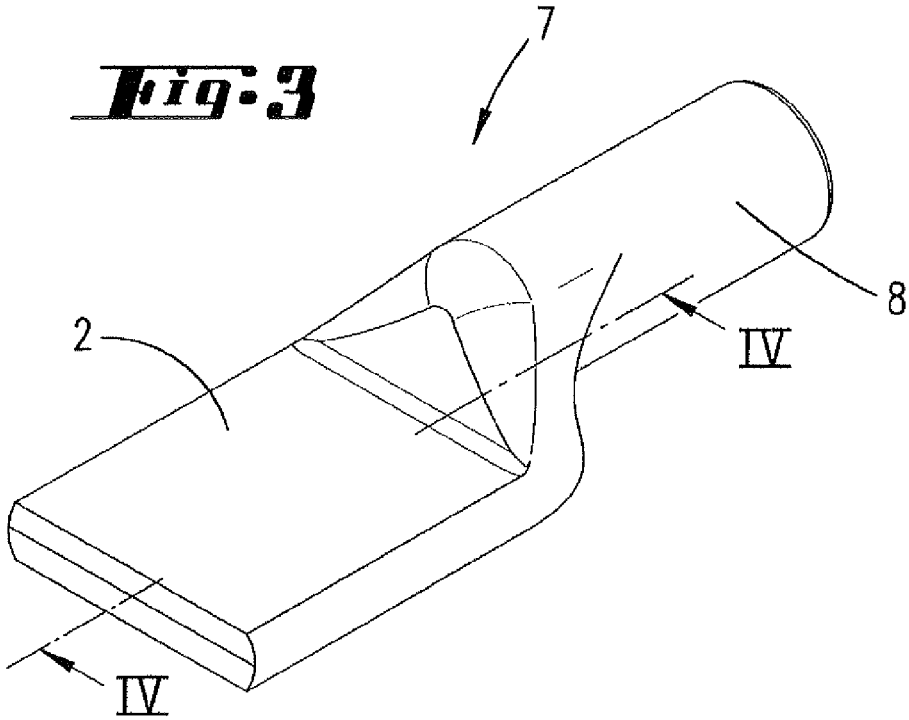
FIG. 3 shows the tube portion according to FIG. 1 after shaping of a flat portion.

After that, an end portion of the tube portion 1 according to FIG. 1 has been pressed together to form a flat part 2, FIG. 3.

Figure 4:
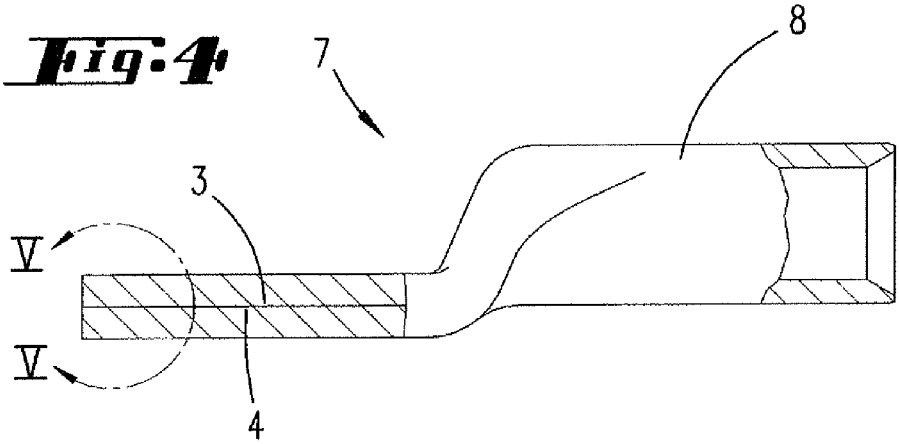
FIG. 4 shows a cross-section through the item of FIG. 3, sectioned partially along the line IV-IV in FIG. 3.

The item according to FIG. 3 thus produced has then been heated-up sufficiently, although this is not illustrated in detail, for a bond in which the material is fused together to be established in the region of the surfaces 3, 4 in the flat portion 2 that lie on one another, this being indicated in the cross-sectional illustration according to FIG. 4. In this connection, the layers provided by the tin-plating are not differentiated in detail in the illustration of FIG. 4.

DETAILED DESCRIPTION OF THE ILLUSTRATED EMBODIMENTS

Figure 5:
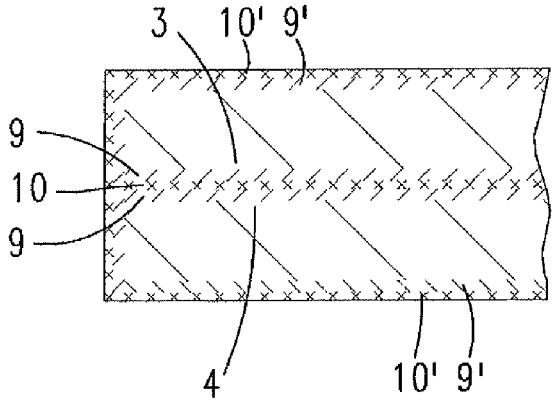
FIG. 5 shows a detail enlargement of V-V from FIG. 4.

The tin coating established is illustrated in further detail in FIG. 5. It is here indicated, with exaggerated thickness for the purposes of illustration, that in the region of the surfaces 3, 4 which face one another, a mixed layer 9 (in each case) is initially formed, in which therefore in the exemplary case a mixture of tin and copper is present. Moreover, there remains, after the heating mentioned, a common tin layer 10. Similar effects take place also on the other surface of the cable lug, the layers outside the opposed surfaces 3 and 4 being correspondingly designated by 9' and 10'. Here the layer 10' is naturally in each case not a common layer of the opposite portions of the tube.

In the exemplary embodiment, the layer Z of tin is formed with a layer thickness of 5 μm. Embodiments with a lesser layer thickness down to 3 μm have also been produced, it being possible for these to be in principle also suitable for the purpose.

The heating was undertaken at a temperature of approximately 250° C., in particular under protective gas. The—remaining—layer thickness of the tin coating in the region of the superimposed surfaces 3, 4 is less by approximately 10 to 50% than a mathematical addition of the starting layer thicknesses.

After the heating, punching-out of the opening 5 is undertaken, along with the formation of the rounded portion 6 at the free end of the flat part 2, so that overall the cable lug 7 illustrated in FIG. 4 has been produced.

After this punching/stamping, the cable lug 7 according to FIG. 4 is once again coated with tin, which is likewise not illustrated in detail.

Figure 6:
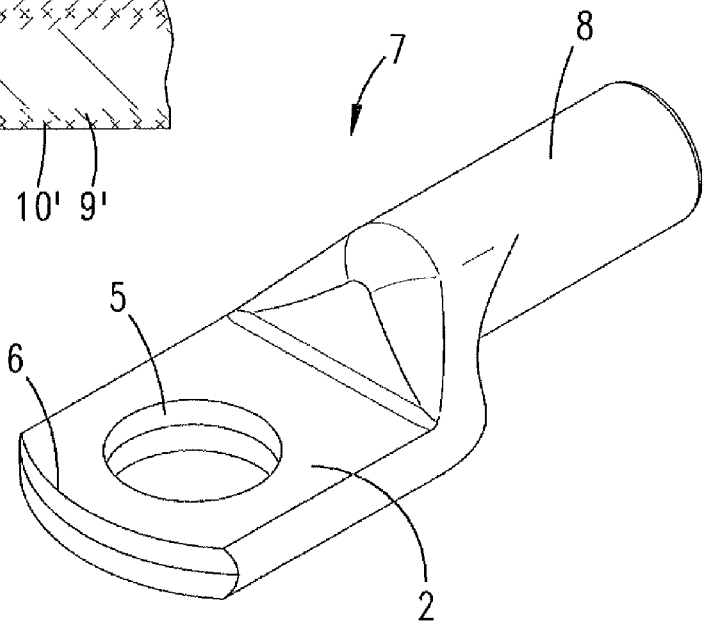
FIG. 6 shows the item of FIGS. 3 and 4 after punching/stamping.

Accordingly, there is then achieved according to FIG. 6 a conventional cable lug with a flat part 2 and a plug-in tube portion 8.

Figure 7:
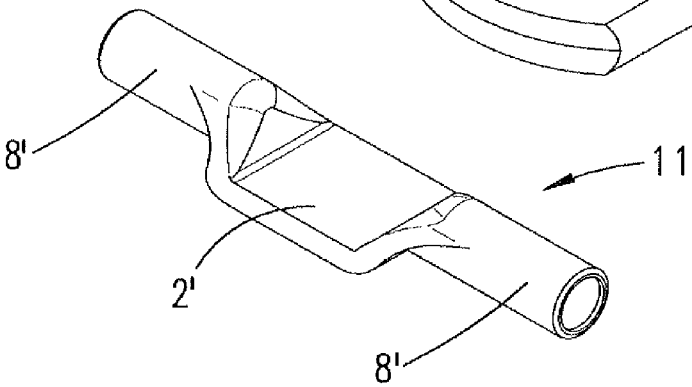
FIG. 7 is a perspective illustration of a cable receptacle or a butt connector.

Referring to FIG. 7, there is illustrated a butt-connector 11 produced by the same method.

Beginning with a tube portion 1 according to FIG. 1 of suitable length, the tube portion 1 was pressed together only in the central region, so that plug-in tube portions 8' were provided to each side. It is pertinent that complete tightness is achieved in the flat portion 2' by the pressing-together and the heating, so that there is no possibility of moisture penetrating from one of the plug-in tube portions 8' into the other plug-in tube portion 8'.

Punching of the flat portion 2' may optionally also be carried out, corresponding to the opening 5 for the cable lug according to FIG. 6.

All features disclosed are (individually) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. Method for producing a cable lug or a cable receptacle comprising:

providing a metallic tube portion;

coating said metallic tube portion with a layer of tin by electroplating;

pressing an end of the tube portion together to form a flat part, said flat part having surfaces which abut against each other; and thereafter heating the flat part so that a firmly-bonded connection is provided between the abutting surfaces of the flat part.

2. Method for producing a cable lug or a cable receptacle, according to claim 1, wherein the tube portion is heated to more than 200° C.

3. Method for producing a cable lug or a cable receptacle, according to claim 1, wherein the tube portion is heated to more than 250° C.

4. Method for producing a cable lug or a cable receptacle, according to claim 1, wherein the tube portion is heated under a protective gas.

5. Method for producing a cable lug or cable receptacle according to claim 1, wherein following the heating, a rounded region is stamped on the flat part.

6. Method for producing a cable lug or a cable receptacle, according to claim 1, wherein before the heating, the flat part is punched to form an opening therethrough.

7. Method for producing a cable lug or a cable receptacle, according to claim 6, wherein after the opening is punched through the flat part and the flat part is heated, the tube portion and flat part are coated with a second layer of tin.

8. Method for producing a cable lug or cable receptacle according to claim 1, wherein following the heating, the flat part is punched to form an opening therethrough.

9. Method for producing a cable lug or a cable receptacle, according to claim 8, wherein after the opening is punched through the flat part, the tube portion and flat part are coated with a second layer of tin.

10. Method for producing a cable lug or cable receptacle according to claim 1, wherein before the heating, a rounded region is stamped on the flat part.

11. Method for producing a cable lug or a cable receptacle, according to claim 10, wherein after the rounded region is stamped and the flat part is heated, the tube portion and flat part are coated with a second layer of tin.

12. A cable lug or a cable receptacle comprising:

a flat part and a tube portion integrally formed together as one piece, the flat part having opposing surfaces which abut against each other, the flat part and tube portion being plated with tin such that an integral bond is established between the abutting surfaces of the flat part.

13. A cable lug or a cable receptacle according to claim 12, further including a rounded region provided on an end of said flat part.

14. A cable lug or a cable receptacle according to claim 12, further including an aperture provided through said flat part.

15. Method for producing a cable lug or a cable receptacle, according to claim 14, wherein after the rounded region is stamped, the tube portion and flat part are coated with a second layer of tin.

* * * * *